US006397788B2

(12) United States Patent
Besik

(10) Patent No.: US 6,397,788 B2
(45) Date of Patent: Jun. 4, 2002

(54) COMPACT ULTRA HIGH EFFICIENCY GAS FIRED STEAM GENERATOR

(76) Inventor: Ferdinand K. Besik, 2562 Oshkin Crt, Mississauga, Ontario (CA), L5N 3Z3

( * ) Notice: Subject to any disclaimer, the term of this patent is extended or adjusted under 35 U.S.C. 154(b) by 0 days.

(21) Appl. No.: 09/835,774

(22) Filed: Apr. 16, 2001

Related U.S. Application Data

(63) Continuation-in-part of application No. 09/419,577, filed on Oct. 18, 1999, and a continuation-in-part of application No. 08/657,179, filed on Jun. 3, 1996, now abandoned.

(51) Int. Cl.[7] ..... F16T 1/38

(52) U.S. Cl. ..... 122/367.3; 122/491

(58) Field of Search ..... 122/31.1, 367.3, 122/414, 479.2, 488, 491, 368

(56) References Cited

U.S. PATENT DOCUMENTS 3,915,124 A * 10/1975 Kuhn, Jr. et al. ..... 122/367.3
4,613,071 A * 9/1986 Omori ..... 237/9 R
4,974,411 A * 12/1990 Bruckner et al. ..... 122/4 D
5,161,488 A * 11/1992 Natter ..... 122/1 R

* cited by examiner

*Primary Examiner*—Gregory Wilson

(57) ABSTRACT

A compact gas fired steam generator comprises a steam separation chamber integrated with vertical fin tubes, a down comer tube and a tube header immersed in a thermally insulated firebox chamber provided with horizontally firing gas burners, a condensing heat exchanger for recovery of the waste heat from flue gases to preheat the feed water and the return condensate and a heat exchanger to recover waste heat from the blow down boiling water to the incoming feed water, all enclosed in a thermally insulated casing.

The steam is produced in said vertical fin tubes by boiling and evaporating a recirculating boiling water by the heat transferred to the boiling water from hot combustion gases produced in said firebox chamber, with said produced steam being separated from the recirculating boiling water in said steam separation chamber. The water level in the steam separation chamber is maintained by the continuous production of steam and flow of feed water and the concentration of dissolved and suspended solids in the recirculating boiling water is maintained by a continuous overflow of a small portion of the boiling water.

The high rate internal reticulation of boiling water, the extended heat transfer surfaces of the vertical fin tubes and the effective contact of the combustion gases with the extended heat transfer surfaces provide an exceptionally compact steam generator offering ultrahigh thermal efficiency and substantionally maintenance free unattended operation.

The compact steam generator can be used in humidification of air, in various heating applications and in industrial processes requiring clean steam.

20 Claims, 1 Drawing Sheet

COMPACT ULTRA HIGH EFFICIENCY GAS FIRED STEAM GENERATOR

CROSS-REFERENCE TO RELATED APPLICATION

This Application is a continuation-in-part of my earlier application Ser. No. 08/657,179 entitled Compact Gas Fired Steam Generator, filed Jun. 3, 1996, now abandoned and Ser. No. 09/419,577 entitled Compact Gas Fired Humidifier, filed Oct. 18, 1999.

FIELD OF INVENTION

The present invention relates to a compact ultra high efficiency gas fired steam generator. The apparatus produces low pressure or atmospheric steam for use in humidification of air and various heating applications in heating, ventilation and air conditioning of buildings and in various industrial processes requiring clean steam.

BACKGROUND

To carry out many industrial processes and manufacturing operations it is often necessary to maintain the temperature and humidity of the working environment and the space air at specific preset temperature-humidity conditions.

In the forced air heating, ventilation and air conditioning of industrial, commercial, institutional and residential buildings the required humidity of the air is most conveniently maintained by addition of the atmospheric steam into the building's recirculating air. For such humidification of the air the generation of the low pressure or the atmospheric steam on site is the most economic and often the only available alternative.

Technical and commercial literature indicate, that the current art compact isothermic humidifiers are producing the atmospheric steam by boiling and evaporating the incoming feed water at atmospheric pressure in sealed water tanks. The required heat is provided either by electric power via two or more electrodes or resistance heating elements submerged in the boiling water, or by a pressure steam delivered from a central steam boiler to a submerged heat exchanger, or by combustion of natural gas in immersion tube burners in water tanks.

Disclosed in U.S. Pat. No. 5,816,496 is a gas fired steam generator-humidifier with an integrated combustion chamber-heat exchanger submerged in a rectangular water tank.

Disclosed in my earlier applications Ser. No. 08/657,179 entitled Compact Gas Fired Steam Generator, filed Jun. 3, 1996 and Ser. No. 09/419,577 entitled Compact Gas Fired Humidifier, filed Oct. 18, 1999 is a compact gas fired steam generator comprising an insulated dry firebox combustion chamber integrated with a vertical finned tube boiler with a high rate internal reticulation of boiling water.

In the current art gas fired steam generator-humidifiers operating with feed water containing disolved solids (DS) the flow of the feed water into the water tank is periodic and the steam generation process is cyclic. The flow of the feed water into the water tank is maintained by solenoid valves and water level switches with the water level in the water tank fluctuating between a high and low water level limits. The cyclic steam generation process includes two operating periods. The first operating period involves steps including transfer of heat from the heat source into the boiling water, evaporation of the boiling water, precipitation of DS and concentration of total solids (TS) in the boiling water, separation of the produced steam from the boiling water, and discharge of the produced steam from the water tank. The following second operating period, in addition to the above steps, includes filling up of the water tank with make up water, draining of a small portion of the boiling water, and heating the feed water to its boiling temperature.

Because of the periodic intake of cool feed water into the water tank, the rate of production of steam during the second operating period is reduced. Depending on the flow rate of feed water, temperature of the water in the water tank may fall below the boiling point when the steam is not produced. As a result, the steam is produced at an unsteady rate and the overall thermal efficiency is limited and at the 80% level. It is therefore desirable to provide an improved steam generator maintaining continuous steady state production of steam at higher thermal efficiency.

The current art gas fired steam generator-humidifiers also have a water seal to allow for periodic overflow of the blow down boiling water while preventing steam from escaping through the overflow outlet. With such overflow water seal arrangement, the steam pressure in the tank is limited by the height of the overflow tube. It is therefore also desirable to provide an improved steam generator that would operate at higher steam pressures.

The feed water used in current art steam generator-humidifier systems may be a city water, softened water, deionized water (DI) or reverse osmosis treated water (RO). As the feed water is converted to steam, impurities which enter with feed water are concentrated and the inorganic hard scale forming substances such as calcium and magnesium precipitate. The precipitated substances build up as hard scale on the submerged heat transfer surfaces requiring regular cleaning of the water tank. It is therefore also desirable to provide an improved steam generator that would provide minimum build up of the hard scale on the heat transfer surfaces.

To provide the required heat transfer area, the current art gas fired water tank steam generator-humidifiers require relatively large and heavy water tanks, containing large volume of boiling water causing a delayed response in steam production. It is therefore also desirable to provide an improved steam generator with minimum volume of the boiling water permitting an instantaneous production of steam.

BRIEF DESCRIPTION OF THE INVENTION

Briefly, and in general terms, the present invention provides for a compact gas fired steam generator producing a steady state continuous flow of clean low pressure or atmospheric steam at an ultra high thermal efficiency for use in humidification of air and in various heating applications in heating, ventilation and air conditioning of buildings and in industrial processes requiring clean steam.

The improved compact steam generator of the present invention comprises a casing, an insulated firebox chamber integrated with an immersed vertical fin tube boiler including a steam separation chamber, a condensing heat exchanger for recovery of the waste heat from flue gases to preheat the feed water and the return condensate and a heat exchanger to recover waste heat from the blow down boiling water to the incoming feed water. It uses a high rate steam generating process occurring in vertical fin tubes in an internally recirculating boiling water. The flow of feed water and the production of low pressure steam are continuous, with the produced steam being separated from the recirculating boiling water in the boiler's steam separation chamber. The water level in the steam separation chamber is maintained at a constant water level by a float switch operating a solenoid valve controlling the continuous overflow of a small portion of the recirculating boiling water to drain to maintain the concentration of dissolved and suspended solids in the internally recirculating boiling water at a preset level. The high rate internal reticulation of boiling water, the extended heat transfer surfaces of the vertical finned tubes and the effective contact of the combustion gases with the extended heat transfer surfaces provide an exceptionally compact apparatus offering ultrahigh thermal efficiency and substantionally maintenance free unattended operation.

In another preferred embodiment of the present invention the steam is produced at an atmospheric pressure and the water level in the steam separation chamber is maintained at a constant water level by a continuous overflow of a small portion of the recirculating boiling water through a water seal to drain to maintain the concentration of dissolved and suspended solids in the internally recirculating boiling water at a preset level while preventing steam from escaping through the overflow outlet.

Another aspect of the present invention is operation of the compact steam generator at a negative pressure to prevent leakage of combustion products into the building and to permit addition of dilution air to the cooled combustion products to lower their dew point to eliminate condensation of moisture in flue duct.

These and other features and advantages of this invention will become apparent from the following detailed description, and the accompanying drawings, which illustrate by way of example the features of the invention.

BRIEF DESCRIPTION OF DRAWINGS

The invention is illustrated by way of example with reference to the accompanying drawings wherein.

DETAILED DESCRIPTION OF THE PREFERRED EMBODIMENTS

Figures 1, 2, 3, 4:
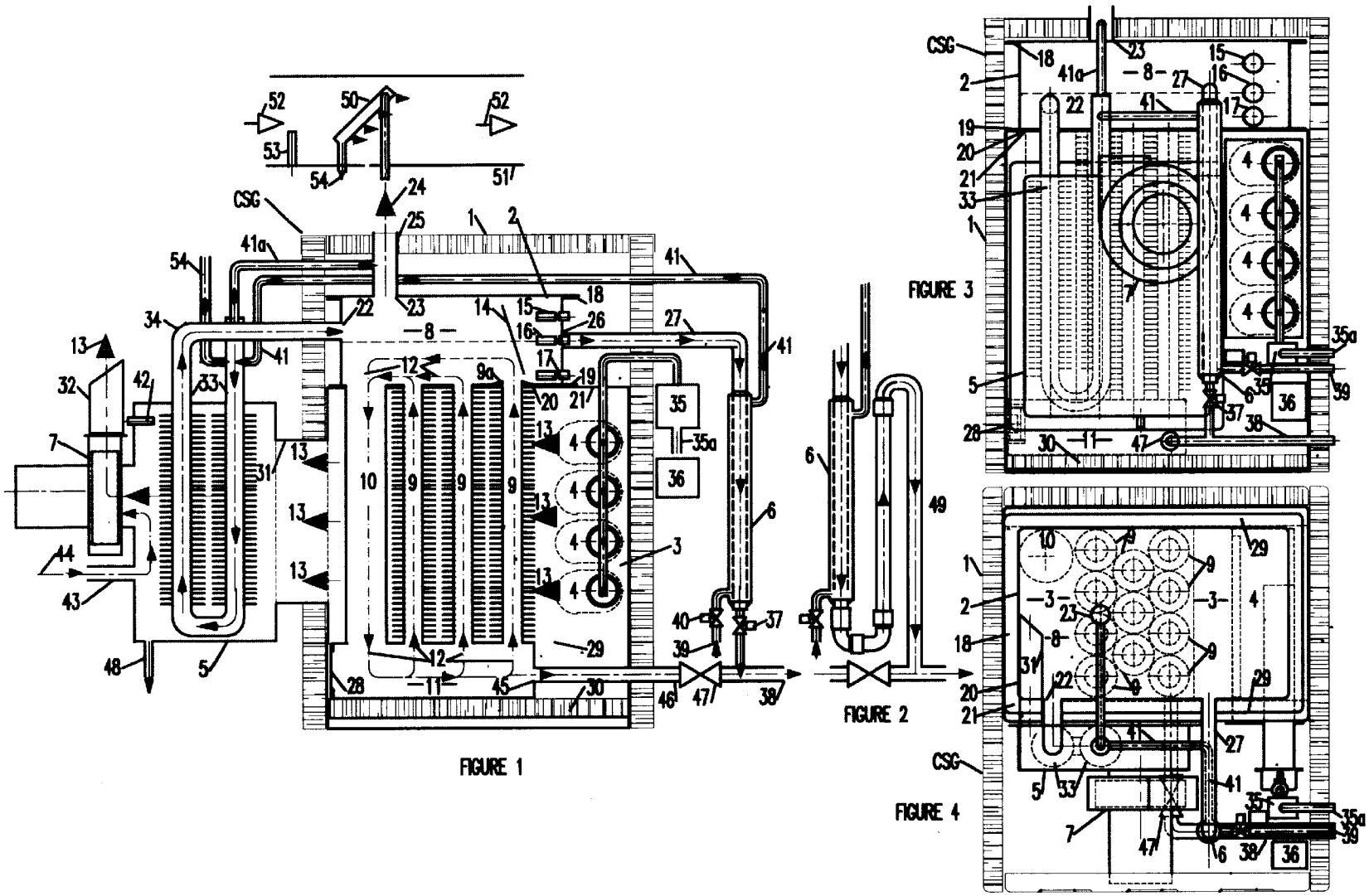
FIG. 1 is a schematic illustration of a preferred embodiment of the compact gas fired steam generator of the present invention intended for production of clean low pressure steam from feed water containing DS for humidification of air in a typical forced air heating-ventilation-airconditioning system of a building.
FIG. 2 is a schematic illustration of another preferred embodiment of the compact gas fired steam generator of the present invention producing the steam at atmospheric pressure.
FIG. 3 is a front view of the compact gas fired steam generator illustrated in FIG. 1.
FIG. 4 is a top view of the compact gas fired steam generator illustrated in FIG. 1.

There are three general types of applications of the invention, each requiring some modification of the apparatus. These are: a) production of steam from feed water, with said produced steam consumed in a specific process, b) production of steam from steam condensate, with the produced steam used in a heating operation and with the steam condensate being returned to the steam generator and c) production of steam from make up water and steam condensate, with portion of the produced steam being consumed in a specific process and the remainder being used in a heating operation with the steam condensate being returned to the steam generator.

Schematically illustrated in FIG. 1, is one preferred embodiment of a compact steam generator CSG of the invention that provides steam 24 to a steam distributor 50 located in air duct 51 of a forced air heating, ventilation and air conditioning system of a building to humidify the building's recirculating air 52. The humidification process and operation of the steam generator CSG is controlled by a humidistat 53. Alternately, in another preferred embodiment of the invention, the steam distributor 50 may be replaced with a condensing heat exchanger and the produced steam 24 may be used for heating of the building's recirculating air, with the steam condensate 54 being returned to the steam generator CSG and with the operation of the steam generator being controlled by a thermostat. Various arrangements for humidification or heating of the building's recirculating air are well known and as they are not the object of this invention, they are not further described.

The compact steam generator CSG illustrated in FIG. 1, FIG. 3 and FIG. 4 has a casing 1 comprising of front, rear, side and top thermally insulated walls, a vertical boiler 2 that projects into a thermally insulated firebox chamber 3 provided with burners 4, a condensing heat exchanger 5, a blow down heat exchanger 6 and an exhaust fan 7.

The boiler 2 is a sealed flanged type unit designed to operate at low pressure. It comprises a steam separation chamber 8, three rows of vertical fin tubes 9, a downcomer tube 10 and a bottom header 11 immersed the fire box chamber 3. The header 11 is provided with sealed flanged opening 28 for inspection and cleaning and opening 45 to drain the boiler's water via conduit 46 and valve 47 to drain 38.

The fin tubes 9 and the down comer tube 10 are connected with their open top ends to the steam chamber 8 and with their open bottom ends to the header 11 for permitting recirculation of the boiling water in the boiler as illustrated by arrows 12. The fin tubes 9 are closely spaced from the side walls of the firebox chamber 3 so that the open space between the fins of the fin tubes 9 provides a horizontal flow path for the combustion gases 13 passing through the combustion, radiation and convection zones of the fire box chamber 3 for transfer of the heat from the hot combustion gases through walls of the fin tubes 9 to the recirculating boiling water therein. The major portion of the available heat in the hot combustion products 13 is transferred by radiation and convection through the walls of the first row of fin tubes 9, the remainder by convection through the walls of the second and third row of fin tubes 9. The evaporation of the recirculating boiling water in the vertical fin tubes 9 in the form of small bubbles causes a high rate internal recirculation of the boiling water within the boiler. To compensate for the thermal expansion of the first row of fin tubes 9, in larger capacity steam generators, these may be provided with expansion joints 9*a*.

The high recirculation rate of the boiling water and the extended surfaces of the fin tubes 9 provide a high overall heat transfer rate from the combustion gases to the boiling water, permitting a very compact design of the steam generator. In addition, the recirculating boiling water maintains the formed precipitate in suspension, permitting continuous removal of the precipitated solids from the boiler 2 by continuous overflow of the blow down boiling water. Thus, the formation of the hard scale on the heat transfer surfaces is minimized and the high overall heat transfer rate and production of steam maintained.

The firebox chamber 3, housing the vertical boiler 2 and horizontally firing burners 4, includes the side and bottom walls 29 provided with thermal insulation 30 to prevent heat loss from the hot combustion products 13 produced by combustion of natural gas with combustion air in burners 4. The top wall 21 has an opening 20 for immersion of the vertical boiler 2, the side wall 29 openings for immersion of the burners 4 and in the rear of the fire box chamber there is an opening 31 for exit of the cooled combustion gases 13. The combustion of natural gas with combustion air in burners 4 is maintained by a conventional gas valve 35 controlled by automatic combustion controls 36 which in turn are controlled by the humidistat or thermostat 53 controlling the humidification and/or heating of the building's recirculating air 52 in air duct 51. The fire box chamber operates under draft induced by the exhaust fan 7 that discharges the cooled combustion gases 13 via flue duct 32 to outdoors. To prevent condensation of moisture in flue duct 32, there is a conduit 43 for intake of dilution air 44 drawn into the exhaust fan 7 to lower the flue's dew point. To protect the steam generator against overheating a temperature limit switch 42 is located in the intake of the exhaust fan 7 to shut down the steam generator when the temperature of the flues exceeds the normal operating temperature.

The steam chamber 8 located at the top of the boiler 2 is provided to separate the steam from the boiling water and to permit a high rate internal recirculation of the boiling water. Partition 14 located in the steam chamber is to shield the float switches 15, 16 and 17 located in the steam chamber 8 from the recirculating boiling water. The top flange 18 is provided for cleaning of the steam chamber 8 and the boiler's tubes 9 and 10 and the bottom flange 19 for immersing the boiler 2 into the dry firebox chamber 3. The steam chamber 8 is also provided with an inlet opening 22 for feeding the preheated feed water and condensate, an outlet opening 23 for discharging the produced steam 24 via a conduit 25 and an outlet opening 26 for continuous overflow of a small portion of the boiling water via conduit 27 out of the boiler 2.

The heat exchanger 5 is provided to recover latent and sensible waste heat from combustion products 13 drawn by the exhaust fan 7 through the fire box chamber 3, rear opening 31 into and through the heat exchanger 5 to preheat the feed water and condensate flowing through fin tubes 33 of the heat exchanger 5, conduit 34 and inlet 22 into the steam chamber 8. The condensate collected from the cooled combustion gases 13 in the heat exchanger 5 is drained via conduit 48 to drain 38.

The heat exchanger 6 is provided to recover heat from the blow down boiling water overflowing from the steam chamber 8 via opening 26, conduit 27 into the heat exchanger 6, then through the solenoid valve 37 to drain 38, to preheat the incoming feed water 39. Operation of the solenoid valve 37 is controlled by the float switch 16 maintaining a constant water level in the steam separation chamber 8. A safety float switch controller 15 is provided to stop the operation of the steam generator if for some reason the water level in the steam chamber 8 rises above the normal operating level and a safety float switch controller 17 to stop its operation if the water level in the steam chamber 8 drops below the normal operating level.

With recovery of waste heat from cooled combustion products 13 in the heat exchanger 5 and with recovery of waste heat from the blow down boiling water in heat exchanger 6, the overall thermal efficiency of the steam generator of the invention is increased to a level between 90–95%.

The automatic ON-OFF type of operation of the compact steam generator is as follows. On call from the humidistat 53 the combustion controls 36 start the exhaust fan 7, the ignition and combustion of natural gas in burner 4 and open the feed water solenoid valve 40. With constant flow rate of the natural gas through the gas valve 35, the generated heat flow rate is constant. The feed water 39 flows at a constant flow rate through the solenoid valve 40, heat exchanger 6, conduit 41, fin tubes 33 of the heat exchanger 5, conduit 34 and inlet 22 into the steam chamber 3. The flow rate of the feed water is set to exceed the flow of the produced steam, so that the water level in the steam chamber 8 remains substantially constant and a small stream of the boiling water continuously overflows from the steam chamber 8 via the opening 26, conduit 27, heat exchanger 6, solenoid valve 37 to drain 38. The condensate 54 collected at the steam distributor 50 is returned via fin tubes 33 of the heat exchanger 5, conduit 34 and inlet 22 into the steam chamber 3. The exhaust fan 7 draws the combustion gases through the fire box chamber 3 with the generated heat being continuously transferred from the combustion gases to the recirculating boiling water in the fire box chamber 3, then to the incoming feed water and return condensate in the heat exchanger 5. The heat transferred from the combustion products to the boiling water is constant, the flow rates of feed water, return condensate, produced steam, blow down boiling water and of the cooled combustion products discharged by the exhaust fan 7 via flue duct 32 to outdoor are constant. On reaching the preset humidity of the recirculating air 52, the humidistat deactivates the combustion controls 36, which in turn shut down the operation of the steam generator CSG.

Depending on required operating conditions, the gas valve 35 and the automatic combustion controls 36 may be of an ON-OFF type, a proportional, or a modulating type, with the flow rate of the feed water controlled by various types commercially available flow controllers to provide a continuous production of steam at a varied flow rate.

While the preferred embodiment of the invention was described as being operated under induced draft with the exhaust fan 7 drawing the combustion gases through the fire box chamber 3, heat exchanger 5 to outdoors, it can be appreciated that another embodiment of the invention may be designed and operated under positive pressure, with the air fan 7 forcing the combustion air with the fuel into burners 4 and then forcing the combustion gases through the firebox chamber 3 heat exchanger 5 to outdoors.

While the preferred embodiment of the invention was described with the heat exchanger 5 to recover latent and sensible waste heat from the cooled combustion gases and the heat exchanger 6 to recover waste heat from the blow down boiling water to achieve the high 95% thermal efficiency, it can be appreciated that another embodiment of the invention may be designed and operated without these two heat exchangers with an overall thermal efficiency of about 85%.

While the preferred embodiment of the invention was described for production of low pressure steam, it can be appreciated that another embodiment of the invention may be designed and operated at atmospheric pressure and that the float switch 16 and solenoid valve 37 may be replaced with a water seal 49 as illustrated in FIG. 2.

While the preferred embodiment of the invention was described for production of steam at constant flow rate, it can be appreciated that another embodiment of the invention may be designed using a suitable commercially available flow controller for continuous production of steam at a variable flow rate.

The apparatus of the present invention offers a substantially increased overall heat transfer rates, smaller physical size, instantaneous production of steam under on-off operating conditions and minimum build up of hard scale on the boiler's heat transfer surfaces and it can effectively operate with city water, softened water, steam condensate, deionized water and reverse osmosis treated water.

While the present invention has been described with reference to specific embodiments to demonstrate the features and advantages of the invented apparatus, such specific embodiments are susceptible to modifications to fit other configurations or other applications. Accordingly, the forgoing description is not to be construed in a limiting sense.

What is claimed is:

1. A compact apparatus for production of steam for use in humidification of air, in various heating applications and in industrial processes requiring clean steam, said apparatus including:

a) boiler means for boiling and evaporating water from recirculating boiling water therein, said boiler means including vertical fin tube means, steam separation chamber means, down comer tube means, tube header means and firebox chamber means provided with burner means for burning fuel to produce hot combustion gases therein, said vertical fin tube means provided for transfer of heat from said combustion gases to recirculating boiling water therein to boil and to evaporate said recirculating boiling water in form of small bubbles, and for providing a horizontal flow pathway for said combustion gases passing through said firebox chamber means, said steam separation chamber means provided for separating said small steam bubbles from said recirculating boiling water therein and, being in fluid communication with said vertical fin tube means and said down comer tube means and, being provided with sealed top flange opening means, bottom flange means, partition means, water inlet means, steam outlet means, water outlet means and an opening means for water level control means, said down comer tube means provided for down flow recirculation of said boiling water in said boiler means, said tube header means provided for fluid communication between said down flow tube means and said vertical fin tube means to permit said recirculation of said boiling water in said boiler means and provided with sealed flanged opening means for cleaning and water outlet means for draining of said boiler means, said firebox chamber means provided for housing said vertical fin tube means, down flow tube means, tube header means and burner means, and provided for combustion of fuel with combustion air in said burner means therein and for passing said combustion gases through said horizontal pathway to transfer the heat from said combustion gases to said vertical fin tube means therein, and having the interior side and bottom walls thermally insulated, and having an opening in the top wall for immersion of said vertical boiling means, opening means in the front section for insertion of said burner means and an opening in the rear section for exit of cooled combustion gases, b) water supplying means for supplying the source water for producing said steam in said boiler means, c) water level control means for controlling and maintaining the operating water level in said steam separation chamber means, d) combustion means for safe automatic combustion of a fuel with combustion air and discharge of cooled combustion gases to outdoors and including fuel flow valve control means, ignition means, burner means, air blower means, temperature limit control means, flue duct means and combustion control means, e) steam production control means interconnected with said combustion control means for controlling the production of steam and for maintaining automatic operation of said apparatus, f) draining means for draining said boiler means to drain, and g) casing means for enclosing said apparatus and having thermally insulated side, rear and top walls to minimize heat loss and a removable front wall with an opening for intake of combustion air.

2. Apparatus of claim 1 including in addition heat exchanger means for recovering of waste heat from cooled combustion gases leaving said fire box chamber means to preheat the water entering said boiler means.

3. Apparatus of claim 1 with said vertical boiler means in addition provided with boiling water blow down control means for maintaining the concentration of suspended solids in the boiling water, operating pressure and water level in said steam separation chamber means by automatic blow down of the excess boiling water controlled by valve means.

4. Apparatus of claim 3 including in addition heat exchanger means for recovering of waste heat from cooled combustion gases leaving said fire box chamber means to preheat the water entering said boiler means.

5. Apparatus of claim 4 including in addition heat exchanger means for recovering of waste heat from said blow down boiling water leaving said steam separation chamber means to preheat the water entering said boiler means.

6. Apparatus of claim 3 including in addition heat exchanger means for recovering of waste heat from said blow down boiling water leaving said steam separation chamber means to preheat the water entering said boiler means.

7. Apparatus of claim 1 with said vertical boiler means in addition provided with boiling water blow down control means for maintaining the concentration of suspended solids in the boiling water, operating pressure and water level in said steam separation chamber means by automatic blow down of the excess boiling water controlled by overflow water seal means.

8. Apparatus of claim 7 including in addition heat exchanger means for recovering of waste heat from cooled combustion gases leaving said fire box chamber means to preheat the water entering said boiler means.

9. Apparatus of claim 8 including in addition heat exchanger means for recovering of waste heat from said blow down boiling water leaving said steam separation chamber means to preheat the water entering said boiler means.

10. Apparatus of claim 7 including in addition heat exchanger means for recovering of waste heat from said blow down boiling water leaving said steam separation chamber means to preheat the water entering said boiler means.

11. Apparatus of claim 1 with said vertical boiling means including plain vertical tubes in radiation zone of said firebox chamber means and vertical fin tubes in convection zone of said firebox chamber means.

12. Apparatus of claim 11 including in addition heat exchanger means for recovering of waste heat from cooled combustion gases leaving said fire box chamber means to preheat the water entering said boiler means.

13. Apparatus of claim 12 with said vertical boiler means in addition provided with boiling water blow down control means for maintaining the concentration of suspended solids in said recirculating boiling water, operating pressure and water level in said steam separation chamber means by automatic blow down of the excess boiling water controlled by valve means.

14. Apparatus of claim 13 including in addition heat exchanger means for recovering of waste heat from said blow down boiling water leaving said steam separation chamber means to preheat the water entering said boiler means.

15. Apparatus of claim 12 with said vertical boiler means in addition provided with boiling water blow down control means for maintaining the concentration of suspended solids in said recirculating boiling water, operating pressure and water level in said steam separation chamber means by automatic blow down of the excess boiling water controlled by overflow water seal means.

16. Apparatus of claim 15 including in addition heat exchanger means for recovering of waste heat from said blow down boiling water leaving said steam separation chamber means to preheat the water entering said boiler means.

17. Apparatus of claim 11 with said vertical boiler means in addition provided with boiling water blow down control means for maintaining the concentration of suspended solids in said recirculating boiling water, operating pressure and water level in said steam separation chamber means by automatic blow down of the excess boiling water controlled by valve means.

18. Apparatus of claim 11 with said vertical boiler means in addition provided with boiling water blow down control means for maintaining the concentration of suspended solids in said recirculating boiling water, operating pressure and water level in said steam separation chamber means by automatic blow down of the excess boiling water controlled by overflow water seal means.

19. Apparatus of claim 1 with said vertical boiling means in said radiation zone of said firebox chamber means including vertical fin tubes with a lower number of fins per unit length of tube than said vertical fin tubes in said convection zone of said firebox chamber means.

20. Apparatus of claim 19 including in addition heat exchanger means for recovering of waste heat from cooled combustion gases leaving said fire box chamber means to preheat the water entering said boiler means.

* * * * *